United States Patent [19]

Matesco

[11] Patent Number: 4,803,395

[45] Date of Patent: Feb. 7, 1989

[54] PROCESS FOR THE MANUFACTURE OF A PLATINUM-TIPPED BIMETALLIC CENTRAL ELECTRODE FOR AN IGNITION PLUG AND THE ELECTRODE PRODUCED ACCORDING TO THIS PROCESS

[75] Inventor: Michel Matesco, Moingt Montbrison, France

[73] Assignee: Eyquem, Nanterre, France

[21] Appl. No.: 93,003

[22] Filed: Sep. 4, 1987

[30] Foreign Application Priority Data

Sep. 8, 1986 [FR] France ..... 86 12558

[51] Int. Cl.[4] ..... H01T 21/02

[52] U.S. Cl. ..... 313/141; 445/7; 228/175

[58] Field of Search ..... 445/7; 228/175; 313/141

[56] References Cited

U.S. PATENT DOCUMENTS

| | | | |
|---|---|---|---|
| 2,955,222 | 10/1960 | Beesch | 313/141 |
| 3,332,140 | 7/1987 | Sugiura et al. | 228/175 |
| 3,548,239 | 12/1970 | Eaton | 313/141 X |
| 4,684,352 | 8/1987 | Clark et al. | 445/7 |
| 4,699,600 | 10/1987 | Kondo | 445/7 |
| 4,700,103 | 10/1987 | Yamaguchi et al. | 313/141 |
| 4,705,486 | 11/1987 | Myers et al. | 445/7 |

FOREIGN PATENT DOCUMENTS

| | | | |
|---|---|---|---|
| 122255 | 10/1946 | Australia | 445/7 |
| 904355 | 3/1986 | Belgium . | |
| 171994 | 2/1986 | European Pat. Off. . | |
| 3433683 | 6/1985 | Fed. Rep. of Germany . | |
| 976798 | 12/1964 | United Kingdom | 313/141 |

*Primary Examiner*—Kenneth J. Ramsey

*Attorney, Agent, or Firm*—Wenderoth, Lind & Ponack

[57] ABSTRACT

This process consists in introducing a copper slug (5) into a nickel cup (1), extruding the cup-and-slug assembly and shaping it to produce a bimetallic electrode. It is characterized in that before the introduction of the said copper slug into the cup, a platinum point (2) is fixed onto the nickel cup (1). The invention applies to electrodes for electrical ignition plugs for heat engines.

7 Claims, 1 Drawing Sheet

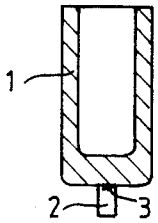
FIG. 1
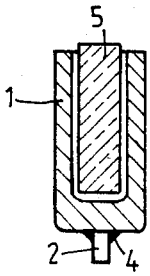
FIG. 2
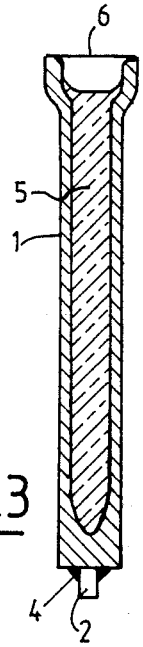
FIG. 3
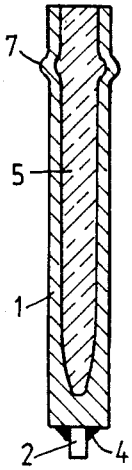
FIG. 4
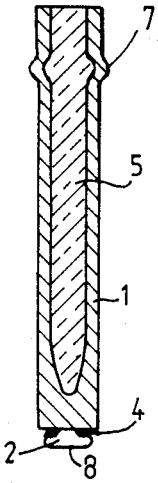
FIG. 5
FIG. 6
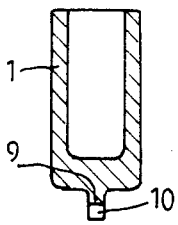
FIG. 7
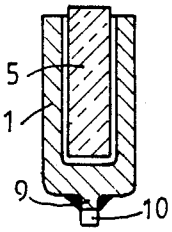

PROCESS FOR THE MANUFACTURE OF A PLATINUM-TIPPED BIMETALLIC CENTRAL ELECTRODE FOR AN IGNITION PLUG AND THE ELECTRODE PRODUCED ACCORDING TO THIS PROCESS

The invention relates to a process for the manufacture of platinum-tipped bimetallic central electrodes for electrical ignition plugs for heat engines.

The two functions of an ignition plug are to ignite a spark between the active central electrode and the earth electrode and to remove the heat energy from the combustion chamber. The construction of the central electrode is therefore of great importance for the above-mentioned functions.

This has led to the production of bimetallic central electrodes with a copper core which improves the heat conduction of the electrode and with a nickel coating.

There are known processes for the manufacture of bimetallic electrodes, consisting essentially of three operations which are well defined in the prior art. In the first operation, a cup is formed from a nickel alloy wire. In a second operation, a copper slug is introduced into the cup and in a third operation the cup and the slug are extruded to produce an electrode which can be employed as an active central electrode in an ignition plug.

In the course of the extrusion, the copper slug forms a core which is used to dissipate heat, this being necessary because the operating temperature in the part exposed to the gas combustion reaches over 800° C.

To improve the characteristics of the spark between the active electrode and the earth electrode, a platinum tip is fixed onto the nickel alloy cup forming, with the end of the cup, a part of the electrode which projects beyond the insulator. This platinum tip may be welded electrically or, according to another process of manufacture, crimped onto the copper-cored bimetallic electrode.

There are also known bimetallic electrodes with a crimped platinum wire extending over the entire length of the electrode.

The known processes for the assembly of a platinum tip onto a central electrode have the disadvantage of poor behaviour of the platinum tip with time because of the weakness of its assembly with the remainder of the electrode.

Such is the case, for example in the process described in the patent BE-A No. 904,355. This document provides a process according to which a precious or semi-precious metal insert is introduced into a hole arranged in a composite billet and is then fastened in this hole by crimping by means of an extrusion operation.

Furthermore, until now it was not possible to fit a platinum tip by brazing onto a bimetallic electrode made of copper and nickel because of the high melting point required for the brazing (approximately 1200° C.), whereas the melting point of copper is lower (approximately 960° C.).

The objective of the invention is to overcome these disadvantages by providing a process for fastening a platinum tip to a central electrode.

Its subject is therefore a process for the manufacture of a platinum-tipped bimetallic central electrode for an ignition plug, consisting in introducing a copper slug into a nickel cup, in extruding the cup-and-slug assembly and in shaping to produce a bimetallic electrode, characterized in that, before the introduction of the said copper slug into the cup, a platinum tip is fastened to the nickel cup.

Another subject of the invention is a platinum tipped bimetallic central electrode for an ignition plug produced according to the process defined above.

The invention will be better understood with the aid of the description which follows, given solely by way of example and made with reference to the attached drawings, in which:

FIGS. 1 to 4 are sectional views showing the successive stages of the process of the invention;

FIG. 5 is a view in lengthwise section showing an additional stage of the process of the invention in order to produce an electrode with a flattened platinum tip; and FIGS. 6 and 7 are views corresponding to FIGS. 1 and 2 showing the initial stages of the process of the invention for the production of an alternative form of a platinum tipped electrode.

FIG. 1 shows the result of the first two operations of the process of the invention, according to which a cylindrical cup 1 is formed from a nickel alloy wire, not shown, and a central platinum tip 2, preferably cylindrical, is welded electrically at 3 onto the end of the cup 1.

The result of the next two operations is shown in FIG. 2. The platinum tip 2, whose melting point is approximately 1770° C. is welded electrically onto the cup 1, whose melting point is approximately 1400° C., and is fastened firmly onto this cup by a high-temperature brazing 4 (approximately 1200° C.) performed under vacuum. A cylindrical copper slug 5 is then introduced into the cup.

FIG. 3 shows an electrode blank produced by extrusion of the assembly formed by the nickel alloy cup 1 and the copper slug 5 which forms an elongate core 5, continuously cylindrical inside the cup 1, the platinum tip 2 and the brazing 4 retaining their shape in the middle of the closed end of the cup.

The extrusion operation is followed by shaping of the electrode according to FIG. 4. The open end 6 of the cup shown in FIG. 3 is cut off to establish the desired length of the electrode. A collar 7 for holding the electrode in the channel of the insulator of a plug (not shown) is then formed.

The bimetallic electrode is then finished.

According to an alternative form, the platinum tip 2 may then be squashed, as shown in FIG. 5, in order to offer a larger active sparking surface 8.

FIGS. 6 and 7 show another embodiment of the process according to the invention contributing an improvement to process described with reference to FIGS. 1 to 5.

The cup 1 is formed with an axial nipple 9 made of the same material, onto which a platinum tip 10 having a length which is reduced in relation to the length of the platinum tip described already is welded electrically and brazed. The inactive length of platinum situated in the brazing can thus be reduced and, since platinum is a very costly precious metal, it is advantageous to be able to reduce the quantity of noble material employed in this manner by up to 50% in relation to the quantities required according to known processes.

After the fitting of the platinum tip 2 onto the nipple 8, by welding and brazing, a copper slug 5 is introduced into the cup, as shown in FIG. 7 and as already described with reference to FIG. 2.

The subsequent stages of manufacture of the electrode are identical to those described with reference to FIGS. 3 to 5.

The process according to the invention thus offers the possibility of performing the brazing of a platinum tip onto a nickel alloy cup and an electrode is thus produced with a platinum tip which is mounted and fastened in a reliable and durable manner. As a result of this, the lifespan of a plug fitted with an electrode of this kind is improved at the same time as the costs of manufacture of the electrode are reduced.

I claim:

1. Process for the manufacture of a platinum-tipped bimetallic central electrode for an ignition plug, consisting in introducing a copper slug (5) into a nickel cup (1), in extruding the cup-and-slug assembly and in shaping it to produce a bimetallic electrode, characterized in that, before the introduction of the said copper slug into the cup, a platinum tip (2) is positioned on the nickel cup (1) by electrical welding in order to ensure its being maintained in place and it is then permanently fastened by a brazing operation under vacuum.

2. Process according to claim 1, characterized in that the said nickel cup (1) is formed with an axial nipple (9) and that the platinum tip (10) is then assembled onto the said nipple (9).

3. Process according to claim 2, characterized in that the platinum tip (2: 10) is squashed after the assembly operation in order to produce a flattened sparking surface (8).

4. Process according to claim 1 or 2, characterized in that the platinum tip (2; 10) is squashed after the assembly operation in order to produce a flattened sparking surface (8).

5. Platinum-tipped bimetallic central electrode for an ignition plug produced by the process according to claim 1.

6. Platinum-tipped bimetallic central electrode for an ignition plug produced by the process according to claim 2.

7. Platinum-tipped bimetallic central electrode for an ignition plug produced by the process according to claim 4.

* * * * *